US010290460B2

(12) United States Patent
Utschig et al.

(10) Patent No.: US 10,290,460 B2
(45) Date of Patent: May 14, 2019

(54) X-RAY TUBE WITH GRIDDING ELECTRODE

(71) Applicant: General Electric Company, Schenectady, NY (US)

(72) Inventors: Michael John Utschig, Milwaukee, WI (US); Uwe Wiedmann, Clifton Park, NY (US); Bruno Kristiaan Bernard De Man, Clifton Park, NY (US); Sergio Lemaitre, Whitefish Bay, WI (US); Mark Alan Frontera, Ballston Lake, NY (US); Antonio Caiafa, Albany, NY (US); Jiahua Fan, New Berlin, WI (US); Adam Budde, Madison, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 318 days.

(21) Appl. No.: 15/258,631

(22) Filed: Sep. 7, 2016

(65) Prior Publication Data

US 2018/0068823 A1 Mar. 8, 2018

(51) Int. Cl.
*H01J 35/02* (2006.01)
*H01J 35/14* (2006.01)
(Continued)

(52) U.S. Cl.
CPC ..... *H01J 35/14* (2013.01); *H01J 35/06* (2013.01); *H01J 35/08* (2013.01); *H05G 1/085* (2013.01); *H05G 1/10* (2013.01); *H05G 1/58* (2013.01)

(58) Field of Classification Search
CPC ..... H01J 35/101; H01J 35/06; H01J 35/08; H01J 2235/106; H01J 2235/1086; H01J 2235/1204; H01J 35/14; H01J 35/26; H01J 9/18; H01J 2235/1013; H01J 2235/1046; H01J 2235/1208; H01J 2235/1295;
(Continued)

(56) References Cited

U.S. PATENT DOCUMENTS

| | | | | |
|---|---|---|---|---|
| 4,413,352 | A | 11/1983 | Nishio | |
| 4,593,371 | A | 6/1986 | Grajewski | |
| 7,406,154 | B2 * | 7/2008 | Resnick | A61B 6/032 378/113 |
| 7,945,024 | B2 | 5/2011 | Lemaitre | |

(Continued)

FOREIGN PATENT DOCUMENTS

| | | | |
|---|---|---|---|
| WO | 2010058330 | A1 | 5/2010 |
| WO | 2010058332 | A2 | 5/2010 |

OTHER PUBLICATIONS

Extended European Search Report and Opinion issued in connection with corresponding EP Application No. 17187019.9 dated Feb. 2, 2018.

*Primary Examiner* — Irakli Kiknadze
(74) *Attorney, Agent, or Firm* — Fletcher Yoder, P.C.

(57) ABSTRACT

An X-ray tube is provided. The X-ray tube includes an electron beam source including a cathode configured to emit an electron beam. The X-ray tube also includes an anode assembly including an anode configured to receive the electron beam and to emit X-rays when impacted by the electron beam. The X-ray tube further includes a gridding electrode disposed about a path of the electron beam between the electron beam source and the anode assembly. The gridding electrode, when powered at a specific level, is configured to grid the electron beam in synchronization with planned transitions during a dynamic focal spot mode.

20 Claims, 8 Drawing Sheets

(51) Int. Cl.

| | |
|---|---|
| ***H01J 35/06*** | (2006.01) |
| ***H01J 35/08*** | (2006.01) |
| ***H05G 1/10*** | (2006.01) |
| ***H05G 1/58*** | (2006.01) |
| ***H05G 1/08*** | (2006.01) |

(58) Field of Classification Search

CPC ..... H01J 35/105; H01J 2235/20; H01J 35/24; H01J 35/30; H01J 35/305; H01J 35/045; H01J 2235/06; H01J 35/04; H01J 2235/02; H01J 2235/064; H01J 2235/068; H01J 2235/1225; H01J 2235/062; H05G 1/085; H05G 1/10; H05G 1/58; H05G 1/34; H05G 1/46; A61B 6/4021; A61B 6/405; A61B 6/4441; A61B 6/54; G01N 23/2252

USPC ..... 378/119, 135–138

See application file for complete search history.

(56) References Cited

U.S. PATENT DOCUMENTS

| | | | | |
|---|---|---|---|---|
| 2003/0021380 | A1 | 1/2003 | Brendler | |
| 2009/0180585 | A1 | 7/2009 | Fujimoto et al. | |
| 2010/0008470 | A1* | 1/2010 | Hauttmann ..... | H01J 35/06 378/135 |
| 2010/0183117 | A1 | 7/2010 | Tsumuraya et al. | |
| 2011/0235785 | A1* | 9/2011 | Behling ..... | H01J 35/04 378/138 |
| 2013/0003912 | A1 | 1/2013 | De Man et al. | |
| 2015/0098548 | A1 | 4/2015 | Bathe et al. | |

* cited by examiner

X-RAY TUBE WITH GRIDDING ELECTRODE

BACKGROUND

The subject matter disclosed herein relates to X-ray tube radiation sources and more particularly to X-ray tube radiation sources having gridding electrodes.

In imaging systems, X-ray tubes are used in projection X-ray systems, fluoroscopy systems, tomosynthesis systems, and computer tomography (CT) systems as a source of X-ray radiation. Typically, the X-ray tube includes a cathode and an anode. The cathode emits a stream of electrons in response to heat resulting from an applied electrical current via the thermionic effect. The anode includes a target that is impacted by the stream of electrons. The target, as a result, produces X-ray radiation and heat. Such systems are useful in medical contexts, but also for parcel and package screening, part inspection, various research contexts, and so forth.

The radiation traverses a subject of interest, such as a human patient, and a portion of the radiation impacts a detector or photographic plate where the image data is collected. In some X-ray systems, the photographic plate is then developed to produce an image which may be used by a radiologist or attending physician for diagnostic purposes. In digital X-ray systems, a photo detector produces signals representative of the amount or intensity of radiation impacting discrete pixel regions of a detector surface. The signals may then be processed to generate an image that may be displayed for review. In CT and tomosynthesis systems, a detector array, including a series of detector elements, produces similar signals through various positions as a gantry is displaced around a patient, and processing techniques are used to reconstruct a useful image of the subject.

In certain imaging systems (e.g., CT systems), the X-ray tube may be utilized in a variety of dynamic focal spot modes. During these dynamic focal spot modes, the imaging system may switch between different focal spot positions (e.g., during focal spot wobbling), different focal spot sizes or shapes, different peak kilovoltages applied across the X-ray tube, different milliamperes applied across the X-ray tube, or a combination there. These transitions or switches during the dynamic focal spot mode may result in damage to the X-ray tube due to focal spot instability or variation and, thus, a shortened X-ray tube life. For example, too large an electron beam (e.g., resulting in damage to beam pipe or other internal apertures thru which the electron beam travels en route to the target) or too small an electron beam (e.g., resulting in target overheating) may result in X-ray tube damage. In addition, focal spot instability may result in reduced image quality due to the acquisition of focal spot artifacts. Further, in an effort to avoid exceeding a temperature limit of the target (e.g., anode) due to overheating or re-heating during the dynamic focal spot mode, the beam power and, thus, the X-ray flux may be limited.

BRIEF DESCRIPTION

In accordance with a first embodiment, an X-ray imaging system is provided. The X-ray imaging system includes an X-ray tube. The X-ray tube includes an electron beam source including a cathode configured to emit an electron beam. The X-ray tube also includes an anode assembly including an anode configured to receive the electron beam and to emit X-rays when impacted by the electron beam. The X-ray tube further includes a gridding electrode disposed about a path of the electron beam between the electron beam source and the anode assembly. The X-ray imaging system also includes a power supply electrically coupled to the electron beam source and the gridding electrode, wherein the power supply is configured to power both the electron beam source and the gridding electrode. The gridding electrode when powered by the power supply at a specific level is configured to grid the electron beam. The X-ray imaging system further includes a controller coupled to the power supply and configured to regulate the power supply in providing power to both the electron beam source and the gridding electrode, wherein the controller is programmed to synchronize the gridding of the electron beam by the gridding electrode with planned transitions during a dynamic focal spot mode.

In accordance with a second embodiment, an X-ray tube is provided. The X-ray tube includes an electron beam source including a cathode configured to emit an electron beam. The X-ray tube also includes an anode assembly including an anode configured to receive the electron beam and to emit X-rays when impacted by the electron beam. The X-ray tube further includes a gridding electrode disposed about a path of the electron beam between the electron beam source and the anode assembly. The gridding electrode, when powered at a specific level, is configured to grid the electron beam in synchronization with planned transitions during a dynamic focal spot mode.

In accordance with a third embodiment, a method for making an X-ray tube is provided. The method includes assembling the X-ray tube comprising an electron beam source including a cathode configured to emit an electron beam and an anode assembly including an anode configured to receive the electron beam and to emit X-rays when impacted by the electron beam. The method also includes disposing a gridding electrode about a path of the electron beam between the electron beam source and the anode assembly. The gridding electrode, when powered at a specific level, is configured to grid the electron beam in synchronization with planned transitions during a dynamic focal spot mode.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
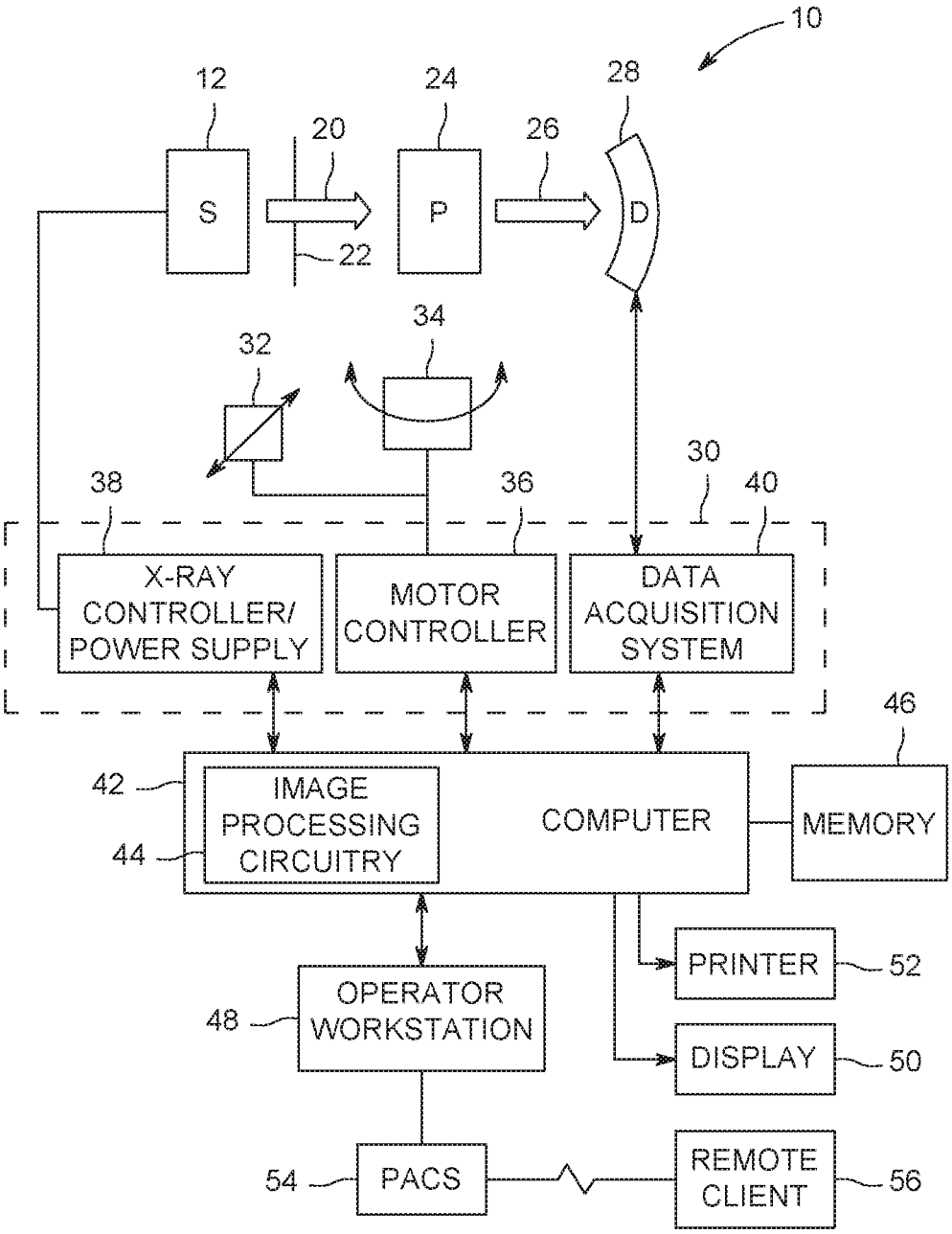
FIG. 1 is a schematic illustration of an embodiment of a computed tomography (CT) system configured to acquire CT images of a patient and process the images in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, an X-ray tube may be utilized in a variety of dynamic focal spot modes (e.g., during CT imaging applications such as focal spot wobbling, spectral imaging, etc.). During these dynamic focal spot modes, the imaging system may switch between different focal spot positions (e.g., during focal spot wobbling), focal spot sizes or shapes, different peak kilovoltages applied across the X-ray tube, different milliamperes applied across the X-ray tube, or a combination thereof. These transitions or switches during the dynamic focal spot mode may result in damage to the X-ray tube due to focal spot instability or variation and, thus, a shortened X-ray tube life. For example, too large an electron beam (e.g., resulting in beam pipe or other internal aperture damage) or too small an electron beam (e.g., resulting in target overheating) may result in X-ray tube damage. In addition, focal spot instability may result in reduced image quality due to the acquisition of focal spot artifacts. Further, in an effort to avoid exceeding a temperature limit of the target (e.g., anode) due to overheating or re-heating during the dynamic focal spot mode, the beam power and, thus, the X-ray flux may be limited.

The embodiments disclosed herein address these and other shortcomings of existing approaches by providing a gridding electrode disposed about a path of an electron beam (e.g., a path extending from a cathode of an electron beam source to an anode target of an anode assembly) between the electron beam source and the anode assembly. The gridding electrode, when powered to a specific level by a power supply (e.g., regulated by a controller), grids the electron beam in synchronization with planned (e.g., pre-programmed or intentional) transitions during a dynamic focal spot mode. The planned transitions may be switches between different focal spot positions (e.g., during focal spot wobbling), different focal spot sizes or shapes, different peak kilovoltages (kVp) applied across the X-ray tube, different milliamperes (mA) applied across the X-ray tube, or a combination thereof. The gridding of the electron beam by the gridding electrode occurs during these transitions (e.g., unstable portions) during the dynamic focal spot mode. In certain embodiments, the electron beam may be fully gridded (i.e., completely blocked from impacting the anode) when the gridding electrode is energized to a specific level (e.g., −3000 volts (V) to −5000 V). In other embodiments, the electron beam may be partially gridded to reduce the electron beam that impacts the anode (e.g., when the gridding electrode is energized at a specific level less than +6000 V). The gridding of the electron beam may occur in a binary manner (e.g., on (no gridding)/off (complete gridding)). In other embodiments, the gridding of the electron beam may occur by switching between full gridding and partial gridding states. In other embodiments, the gridding of the electron beam may occur by switching between no gridding and partial gridding. In some embodiments, a constant partial gridding may be applied to the electron beam. Gridding the electron beam in synchronization with the transitions during a dynamic focal spot mode increases the life of the X-ray tube by avoiding X-ray tube damage due to focal spot instability. In addition, gridding the electron beam in synchronization with the transitions avoids the acquisition of focal spot artifacts in the image data due to focal spot instability. Further, gridding the electron beam in synchronization with the transitions avoids overheating or re-heating issues while increasing the overall beam power and, thus, the X-ray flux that can be utilized.

Prior to discussing certain approaches for utilizing the gridding electrode in dynamic focal spot modes, it may be useful to understand the operation and components of an imaging system in which such an approach may be used. With this in mind, FIG. 1 illustrates an embodiment of an imaging system 10 for acquiring and processing image data in accordance with aspects of the present disclosure. In the illustrated embodiment, system 10 is a computed tomography (CT) system designed to acquire X-ray projection data, to reconstruct the projection data into a volumetric reconstruction, and to process the image data for display and analysis. The CT imaging system 10 includes an X-ray source 12, such an X-ray tube. The X-ray source 12 (e.g., X-ray tube) may be utilized in different imaging applications that utilize dynamic focal spot modes (e.g., wobble focal spot imaging, spectral imaging, etc.). These dynamic focal spot modes include switching between different focal spot positions (e.g., during focal spot wobbling), different kVp applied across the X-ray tube, different mA applied across the X-ray tube, or a combination thereof. In addition, the X-ray source 12 (e.g., X-ray tube) includes a gridding electrode that when powered at a specific level (e.g., less than +6000 V to −5000 V) by a power supply (e.g., regulated by a controller) grids an electron beam in synchronization with planned (e.g., pre-programmed or intentional) transitions during the dynamic focal spot mode. In other words, the gridding of the electron beam is actively managed to correspond with these planned transitions.

In certain implementations, the source 12 may be positioned proximate to a beam shaper 22 used to define the size and shape of the one or more X-ray beams 20 that pass into a region in which a subject 24 (e.g., a patient) or object of interest is positioned. The subject 24 attenuates at least a portion of the X-rays. Resulting attenuated X-rays 26 impact a detector array 28 formed by a plurality of detector elements. Each detector element produces an electrical signal that represents the intensity of the X-ray beam incident at the position of the detector element when the beam strikes the detector 28. Electrical signals are acquired and processed to generate one or more scan datasets.

A system controller 30 commands operation of the imaging system 10 to execute examination protocols and to pre-process or process the acquired data. With respect to the X-ray source 12, the system controller 30 furnishes power, focal spot location, control signals and so forth, for the X-ray examination sequences. The detector 28 is coupled to the system controller 30, which commands acquisition of the signals generated by the detector 28. In addition, the system controller 30, via a motor controller 36, may control operation of a linear positioning subsystem 32 and/or a rotational subsystem 34 used to move components of the imaging system 10 and/or the subject 24.

The system controller 30 (and its associated controllers 36, 38) may include signal processing circuitry and associated memory circuitry. In such embodiments, the memory circuitry may store programs, routines, and/or encoded algorithms executed by the system controller 30 to operate the imaging system 10, including the X-ray source 12 and detector 28, and to process the data acquired by the detector 28. In one embodiment, the system controller 30 may be implemented as all or part of a processor-based system such as a general purpose or application-specific computer system.

The source 12 may be controlled by an X-ray controller/power supply 38 contained within the system controller 30. The X-ray controller 38 may be configured to provide power and timing signals to the source 12. In certain embodiments discussed herein, the X-ray controller 38 may be configured to provide fast-kVp switching of an X-ray source 12 so as to rapidly switch the kVp at which the source 12 is operated to emit X-rays at different respective polychromatic energy spectra in succession during an image acquisition session. In certain embodiments, the X-ray controller 38 may be configured to provide mA switching so as to rapidly switch the mA applied across the X-ray source 12. In certain embodiments, the X-ray controller 38 may be configured to provide focal spot switching (e.g., via beam steering supplies) so as to rapidly switch the focal spot position on a target surface of an anode (e.g., wobble focal spot imaging) or to rapidly switch the focal spot size or shape. In certain embodiments, the X-ray controller 38 may be configured to regulate the power (e.g., level of energization) provided to a gridding electrode of the source 12 to actively manage the gridding of an electron beam emitted by a cathode of the source in synchronization with planned (e.g., pre-programmed or intentional) transitions during the dynamic focal spot mode. Actively managing the gridding of the electron beam involves higher-order electronics, communication methods, and cathode design to enable precision gridding during the transition between different views (i.e., different focal spot positions, different kVp, different mA).

The system controller 30 may include a data acquisition system (DAS) 40. The DAS 40 receives data collected by readout electronics of the detector 28, such as sampled digital or analog signals from the detector 28. The DAS 40 may then convert the data to digital signals for subsequent processing by a processor-based system, such as a computer 42. In other embodiments, the detector 28 may convert the sampled analog signals to digital signals prior to transmission to the data acquisition system 40.

In the depicted example, the computer 42 may include or communicate with one or more non-transitory memory devices 46 that can store data processed by the computer 42, data to be processed by the computer 42, or instructions to be executed by a processor 44 of the computer 42. For example, a processor of the computer 42 may execute one or more sets of instructions stored on the memory 46, which may be a memory of the computer 42, a memory of the processor, firmware, or a similar instantiation.

The computer 42 may also be adapted to control features enabled by the system controller 30 (i.e., scanning operations and data acquisition), such as in response to commands and scanning parameters provided by an operator via an operator workstation 48. The system 10 may also include a display 50 coupled to the operator workstation 48 that allows the operator to view relevant system data, imaging parameters, raw imaging data, reconstructed data, contrast agent density maps produced in accordance with the present disclosure, and so forth. Additionally, the system 10 may include a printer 52 coupled to the operator workstation 48 and configured to print any desired measurement results. The display 50 and the printer 52 may also be connected to the computer 42 directly or via the operator workstation 48. Further, the operator workstation 48 may include or be coupled to a picture archiving and communications system (PACS) 54. PACS 54 may be coupled to a remote system 56, radiology department information system (RIS), hospital information system (HIS) or to an internal or external network, so that others at different locations can gain access to the image data.

Figure 2:
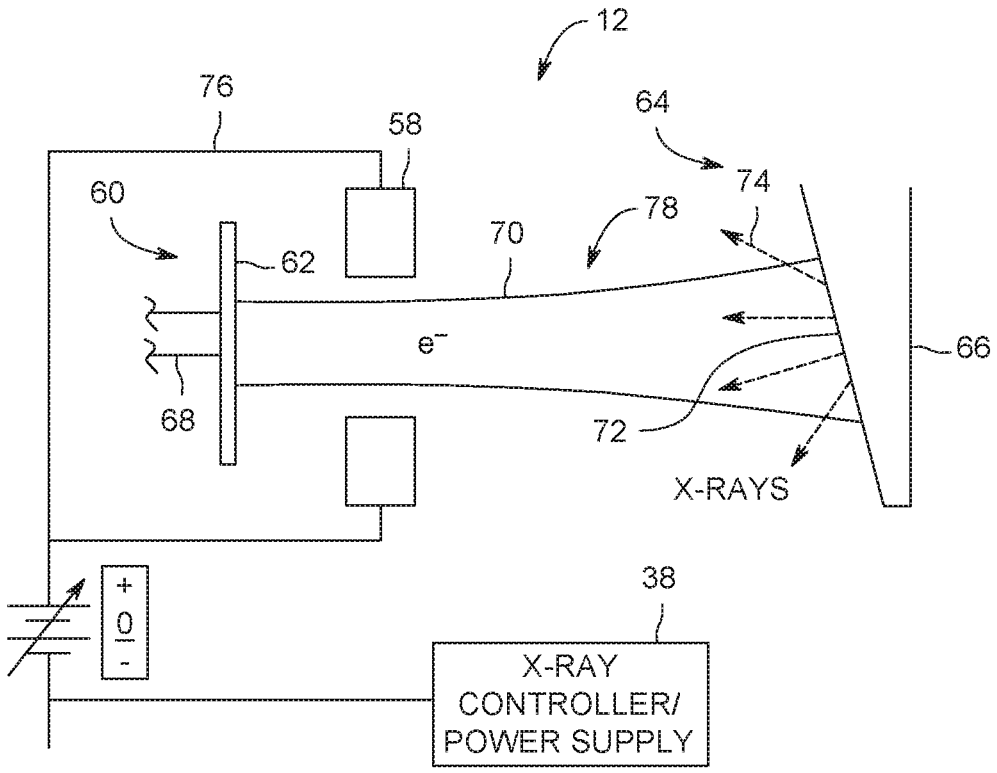
FIG. 2 is a schematic illustration of an embodiment of a portion of an X-ray tube (e.g., having a gridding electrode) coupled to an X-ray controller/power supply (e.g., with no gridding of an electron beam)
Figure 3:
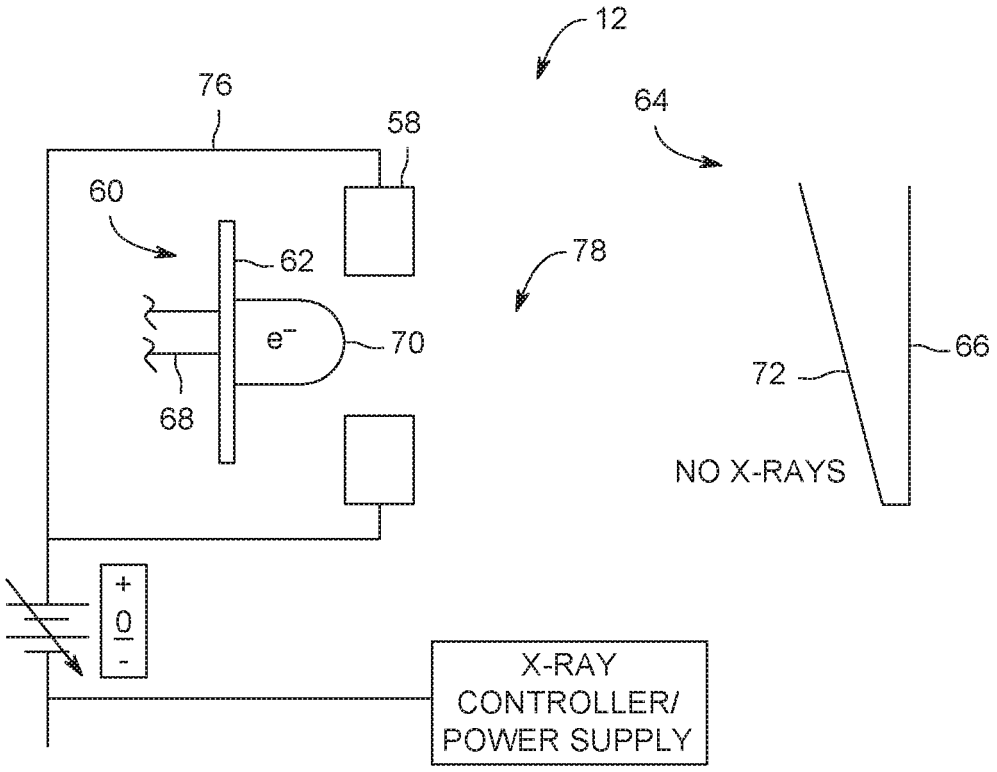
FIG. 3 is a schematic illustration of an embodiment of a portion of an X-ray tube (e.g., having a gridding electrode) coupled to an X-ray controller/power supply (e.g., with gridding of an electron beam)

FIGS. 2 and 3 are schematic illustrations of an embodiment of a portion of an X-ray tube 12 (e.g., having a gridding electrode 58) coupled to an X-ray controller/power supply 38 (e.g., without gridding an electron beam). The X-ray tube 12 includes an electron beam source 60 including a cathode 62, an anode assembly 64 including an anode 66, and a gridding electrode 58. The cathode 62, anode 66, and the gridding electrode 58 may be disposed within an enclosure (not shown) such as a glass or metallic envelope. The X-ray tube 12 may be positioned within a casing (not shown) which may be made of aluminum and lined with lead. In certain embodiments, the anode assembly 64 may include a rotor and a stator (not shown) outside of the X-ray tube 12 at least partially surrounding the rotor for causing rotation of an anode 66 during operation.

The cathode 62 is configured to receive electrical signals via a series of electrical leads 68 (e.g., coupled to a high voltage source) that cause emission of an electron beam 70. The anode 66 is configured to receive the electron beam 70 on a target surface 72 and to emit X-rays, as indicated by dashed lines 74, when impacted by the electron beam 70 as depicted in FIG. 2. The electrical signals may be timing/control signals (via the X-ray controller/power supply 38) that cause the cathode 62 to emit the electron beam 70 at one or more energies. Further, the electrical signals may at least partially control the potential between the cathode 62 and the anode 66. The voltage difference between the cathode 62 and the anode 66 may range from tens of thousands of volts to in excess of hundreds of thousands of volts. The anode 66 is coupled to the rotor (not shown) via a shaft (not shown). Rotation of the anode 66 allows the electron beam 70 to constantly strike a different point on the anode perimeter. Within the enclosure of the X-ray tube 12, a vacuum of the order of $10^{-5}$ to about $10^{-9}$ torr at room temperature is preferably maintained to permit unperturbed transmission of the electron beam 70 between the cathode 62 and the anode 66.

The gridding electrode 58 is configured to receive electrical signals via a series of electrical leads 76 that cause the gridding electrode 58 to grid the electron beam 70. The electrical signals may be timing/control signals (via the X-ray controller/power supply 38) that cause the gridding electrode 58, when energized or powered to a specific level (e.g., less than +6000 V to −5000 V), to grid the electron beam 70. The gridding electrode 58 is disposed about a path 78 of the electron beam 70 between the electron beam source 60 (e.g., cathode 62) and the anode assembly 64 (e.g., anode 66). The gridding electrode 58 may be annularly shaped. As depicted in FIG. 3, when the gridding electrode 58 is powered to a specific level (e.g., −3000 V to −5000 V), the electron beam 70 may be fully gridded or blocked from impacting the anode 66. In certain embodiments, when the gridding electrode is energized at a different level (e.g., less than +6000 V and to −3000 V), the electron beam 70 may be partially gridded resulting in the reduction of the electron beam 70 that impacts the anode 66. If the gridding electrode 58 is powered at a specific non-gridding level (e.g., +6000V), gridding of the electron beam 70 does not occur (as depicted in FIG. 2). As discussed in greater detail below, the gridding of the electron beam 70 by the gridding electrode 58 is synchronized with the planned transitions (e.g., unstable portions) during the dynamic focal spot mode. The gridding of the electron beam 70 may occur in a binary manner (e.g., on (no gridding)/off (complete gridding)). In other embodiments, the gridding of the electron beam may occur by switching between full gridding and partial gridding states. In other embodiments, the gridding of the electron beam may occur by switching between no gridding and partial gridding. In some embodiments, a constant partial gridding may be applied to the electron beam.

Figure 4:
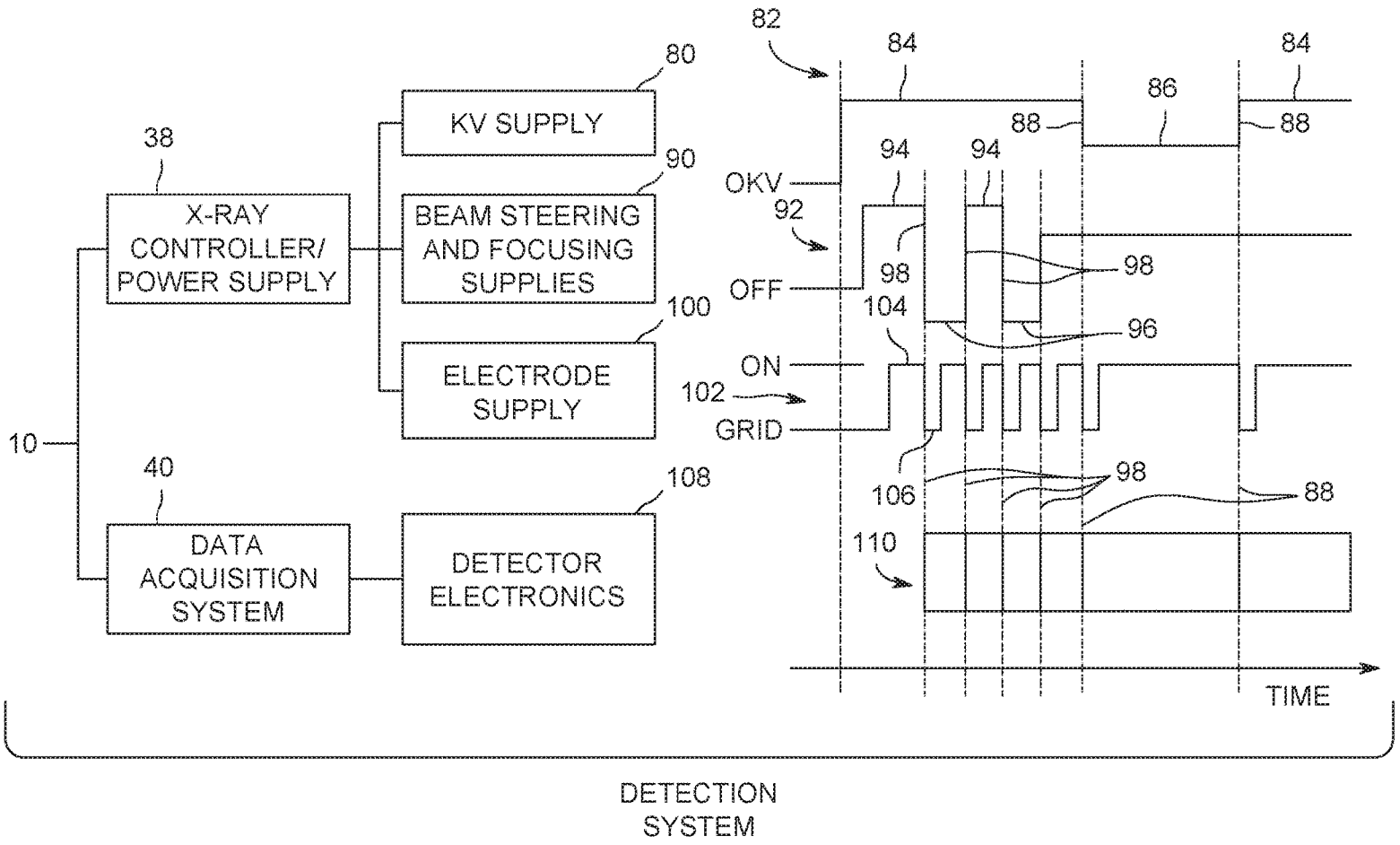
FIG. 4 is a schematic illustration of an embodiment of synchronization of gridding an electron beam with components of the CT system during different focal spot modes.

FIG. 4 is a schematic illustration of synchronization of gridding an electron beam 70 with components of the CT system 10 during different dynamic focal spot modes. As mentioned above, the CT system 10 includes the X-ray controller 38 configured to provide power and timing signals to the source 12. As depicted, the X-ray controller 38 regulates the kV supply 80 to provide fast-kVp switching of an X-ray tube 12 to switch rapidly the kVp at which the X-ray tube 12 is operated to emit X-rays at different respective polychromatic energy spectra in succession during an image acquisition session. For example, as depicted in plot 82 over time, the X-ray controller 38 may switch the X-ray tube 12 from emitting the electron beam 70 at a higher kVp 84 (e.g., 140 kVp) to a lower kVp 86 (e.g., 80 kVp) or vice versa. Planned (pre-programmed) transitions between switching between the different energies are represented by reference numeral 88.

As depicted, the X-ray controller 38 regulates the beam steering and focusing supplies 90 to provide focal spot switching to switch rapidly the focal spot position on a target surface 72 of the anode 66 (e.g., wobble focal spot imaging). In certain embodiments, the X-ray controller 38 regulates the beam steering and focusing supplies 90 to alter focusing of the beam to switch rapidly between different focal spot shapes or sizes. In certain embodiments, the X-ray controller 38 (and beam steering and focusing supplies 90) regulates the power provided to static structures, biased electrostatic electrodes, or electrode magnets to generate an electromagnetic field to steer the electron beam 70 between different focal spot positions or to alter the size or shape of the focal spot. For example, as depicted in plot 92 over time, the X-ray controller 38 regulates the beam steering and focusing supplies 90 to change the focal spot position utilizing a first power level 94 representative of steering the electron beam 70 to a first focal spot position to a second power level 96 representative of steering the electron beam 70 to a second focal spot position different from the first focal spot position. Planned (pre-programmed) transitions between switching between the power levels for changing to the different focal spot positions are represented by reference numeral 98. In certain embodiments, as depicted in plot 92 over time, the X-ray controller 38 regulates the beam steering and focusing supplies 90 to change the focal spot size or shape utilizing a first power level 94 representative of focusing the electron beam 70 to have a first focal spot size or shape on the anode to a second power level 96 representative of focusing the electron beam 70 to a second focal spot size or shape different from the first focal spot size or shape. Similarly, planned (pre-programmed) transitions between the power levels for changing to different focal spot sizes or shapes are represented by reference numeral 98.

As depicted, the X-ray controller 38 regulates the electrode supply 100 to provide power to the gridding electrode 58 of the X-ray tube 12 to actively manage the gridding of the electron beam 70 emitted by the cathode 62 in synchronization with planned (e.g., pre-programmed or intentional) transitions during dynamic focal spot modes. Plot 102 represents the power provided to the gridding electrode 58 to regulate the gridding of the electron beam 70. As depicted in plot 102, when power is at a specific non-gridding level (e.g., +6000 V) to the gridding electrode 58 (represented by reference numeral 104), the electron beam 70 is not gridded and can impact the anode. Also as depicted in plot 102, during the planned (e.g., pre-programmed or intentional) transitions 88, 98 during the dynamic focal spot modes, when power is provided to the gridding electrode 58 at a specific level (e.g., −3000 V to −5000 V), the electron beam 70 is fully gridded (as indicated by reference numeral 106). Plot 102 depicts the example when the gridding electrode 58 is powered in a binary manner (e.g., switching between no gridding and complete gridding). Also, plot 102 depicts the electron beam 70 being fully gridded during the planned transitions 88, 98. In other embodiments, the gridding of the electron beam 70 may occur by switching between full gridding (e.g., during the transitions 88, 98) and partial gridding states (e.g., between the transitions 88, 98). In other embodiments, the gridding of the electron beam 70 may occur by switching between no gridding (e.g., between the transitions 88, 98) and partial gridding (e.g., during the transitions 88, 98). In some embodiments, a constant partial gridding may be applied to the electron beam 70. In this way, the X-ray controller 38 provides the mA switching function to switch rapidly the mA or current applied across the X-ray tube.

Actively managing the gridding of the electron beam 70 involves higher-order electronics, communication methods, and cathode design to enable precision gridding during the transition between different views (i.e., different focal spot positions, different kVp, different mA, different focal spot shapes). For example, the gridding of the electron beam 70 must be coordinated with the utilization of the detector electronics 108 (e.g., controlled by the data acquisition system 40 described above) to acquire the image data as depicted by plot 110. For example, the electron beam gridding time may be synchronized with the detector view trigger time, i.e. the time at which one detector integration frame ends or the next detector integration time starts.

Figure 5:
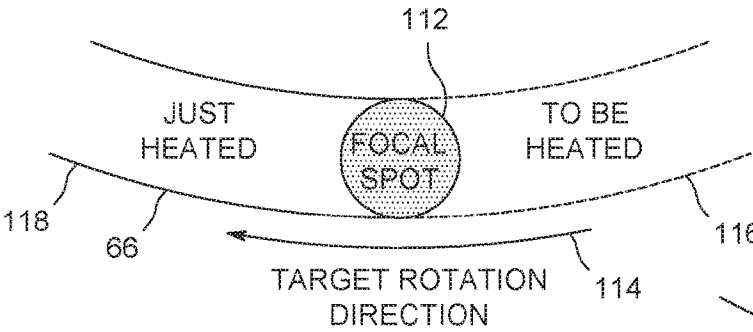
FIG. 5 is a schematic illustration of heating of an anode target during an imaging mode utilizing a static centered spot.

As mentioned above, the gridding electrode 58 may be utilized to grid the electron beam 70 during a dynamic focal spot mode where the electron beam 70 is switched between different focal spots (e.g., wobble focal spot imaging). FIG. 5 is a schematic illustration of the heating of an anode target during an imaging mode that utilizes a static centered spot. As depicted in FIG. 5, the electron beam 70 impacts a single static centered focal spot 112 on the anode 66. The anode 66 rotates in the direction 114 as indicated. With the single static centered focal spot 112, a portion 116 (shown in dashed lines) of the anode 66 prior to the focal spot 112 is about to be heated by the electron beam 70, while a portion 118 of the anode 66 immediately after the focal spot 112 was just heated.

Figure 6:
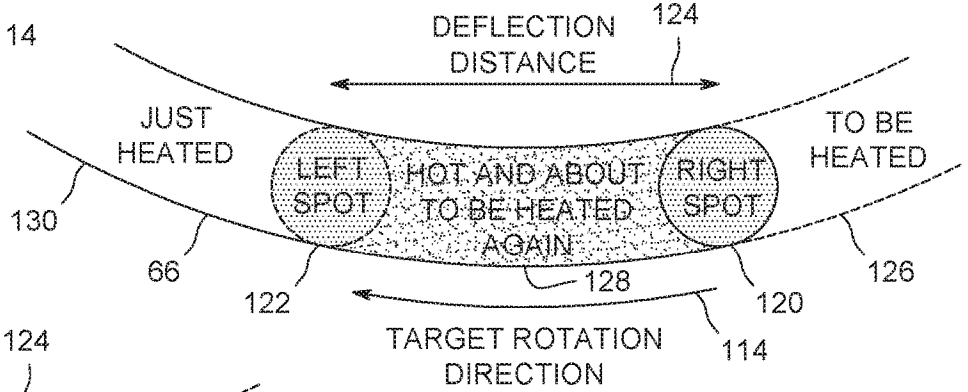
FIG. 6 is a schematic illustration of re-heating of an anode target during a dynamic focal spot mode.

FIG. 6 is a schematic illustration of re-heating of an anode target during a dynamic focal spot mode (e.g., wobble focal spot imaging). FIG. 6 illustrates the problem of re-heating of a target surface as the focal spot is traversed from a first position 120 (e.g., right focal spot) in the direction of target rotation 114 to a second position 122 (e.g., left focal spot shown in a dashed circle) over a target material that just heated by the electron beam 70. Arrow 124 represents the deflection distance of the focal spot from the first position 120 to the second position 122. A portion 126 (shown in dashed lines) of the anode 66 prior to the first position or right focal spot 120 is about to be heated by the electron beam 70, while a portion 128 of the anode 66 immediately after the right focal spot 120 is hot from heating and is about to be heated when the focal spot shifts to the second position or the left focal spot 122. Portion 130 of anode 66 was just heated by the electron beam at the left focal sport 122 prior to the switching or shifting of the focal spot to the right focal spot 120. The target material of the anode 66 has a finite temperature capability and is subject to re-heating as depicted in FIG. 6 during the dynamic focal spot mode (e.g., wobble focal spot imaging). This re-heating of the target limits the overall beam power and the X-ray flux that can be utilized with the X-ray tube 12 to avoid exceeding the temperature limit of the target material.

Figure 7:
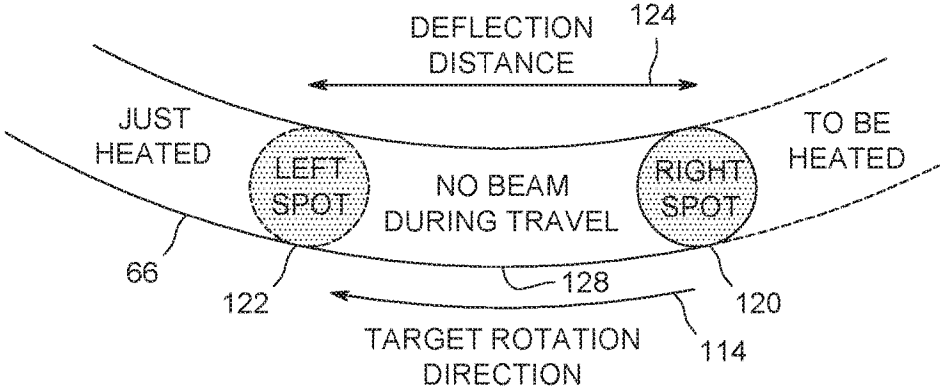
FIG. 7 is a schematic illustration of an embodiment of an effect of gridding an electron beam has on the heating of an anode target during a dynamic focal spot mode.

FIG. 7 illustrates how gridding avoids the issue of re-heating the target. FIG. 7 is a schematic illustration of an embodiment of the effect of gridding the electron beam 70 on the heating of an anode target during a dynamic focal spot mode (e.g., wobble focal spot imaging). The focal spot positions 120, 122 and the portions 126, 128, and 130 are as described in FIG. 6. As depicted, in FIG. 7 when the focal spot of the electron beam 70 is shifted (or deflected) from the right 120 to the left spot 122, the portion 128 of the anode 66 will not be re-heated due to gridding (e.g., full gridding) of the electron beam 70. In certain embodiments, gridding of the electron beam 70 may occur for a time greater than the time to switch between the different focal spot positions (e.g., when the transition switch is faster than the target speed). This enables the portion of the anode 66 that was just heated (e.g., previously at right spot 120) to pass by (e.g., left spot 122) before heating begins again. Avoiding re-heating of the target anode during the dynamic focal spot mode (e.g., wobble focal spot imaging) significantly increases (e.g., up to approximately 30 percent) the overall beam power and, thus, the X-ray flux that can be utilized with the X-ray tube.

Figure 8:
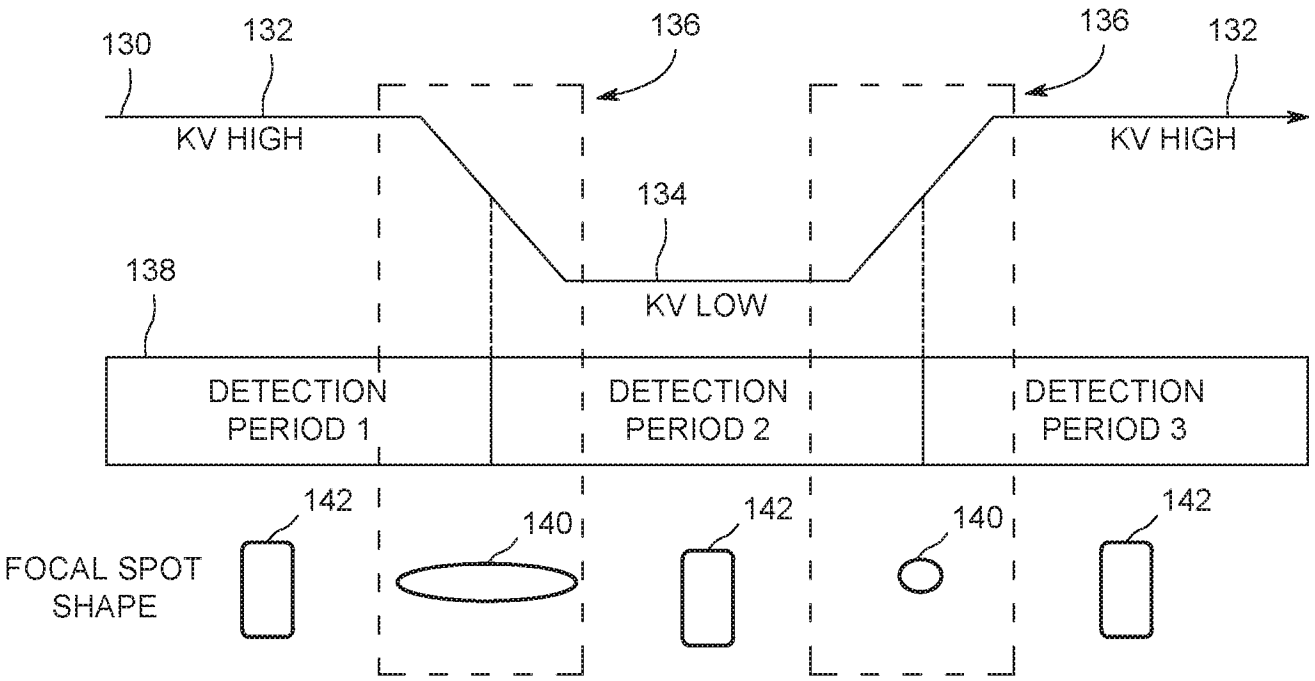
FIG. 8 is a schematic illustration of focal spot size instability during a switching between different kVp levels.

FIG. 8 is a schematic illustration of focal spot size instability during switching between different kVp levels. In dynamic focal spot modes (e.g., fastkVp, spectral imaging, etc.) that change the focal spot kVp, the electrical potential of the X-ray beam varies during the transition between the different kVp levels. Plot 130 depicts the kVp level. As depicted, the kVp level is switched between a higher kVp (e.g., 140 kVp), represented by reference numeral 132, and a lower kVp (e.g., 80 kVp), represented by reference numeral 134. The dashed areas 136 represent the planned transitions between the higher and lower kVps 132, 134. FIG. 8 further depicts the detection periods 138 (e.g., by the detector electronics 108) generally corresponding with the different kVp levels 132, 134. However, as depicted in FIG. 8, these detection periods 138 also overlap with the transitions 136 between the kVp levels. As a result, there is degraded energy discrimination between views (e.g., corresponding to the kVp levels 132, 134) due to the acquisition of signals with mixed-potential during the transitions (i.e., mixed kV integration). In addition, due to variable focal spot potential, focal spot instability may occur during the transitions 136. As depicted in FIG. 8, there is focal spot shape variation between focal spot shapes 140 during the transitions 136 from the focal spot shape 142 outside of these transitions 136. Focal spot size instability as depicted in FIG. 8 affects image quality (e.g., due to focal spot artifacts) and may cause damage to the X-ray tube 12. For example, too large an electron beam (e.g., resulting in beam pipe damage and shortening tube life) or too small an electron beam (e.g., resulting in target overheating and limiting power capability) may result in X-ray tube damage.

Figure 9:
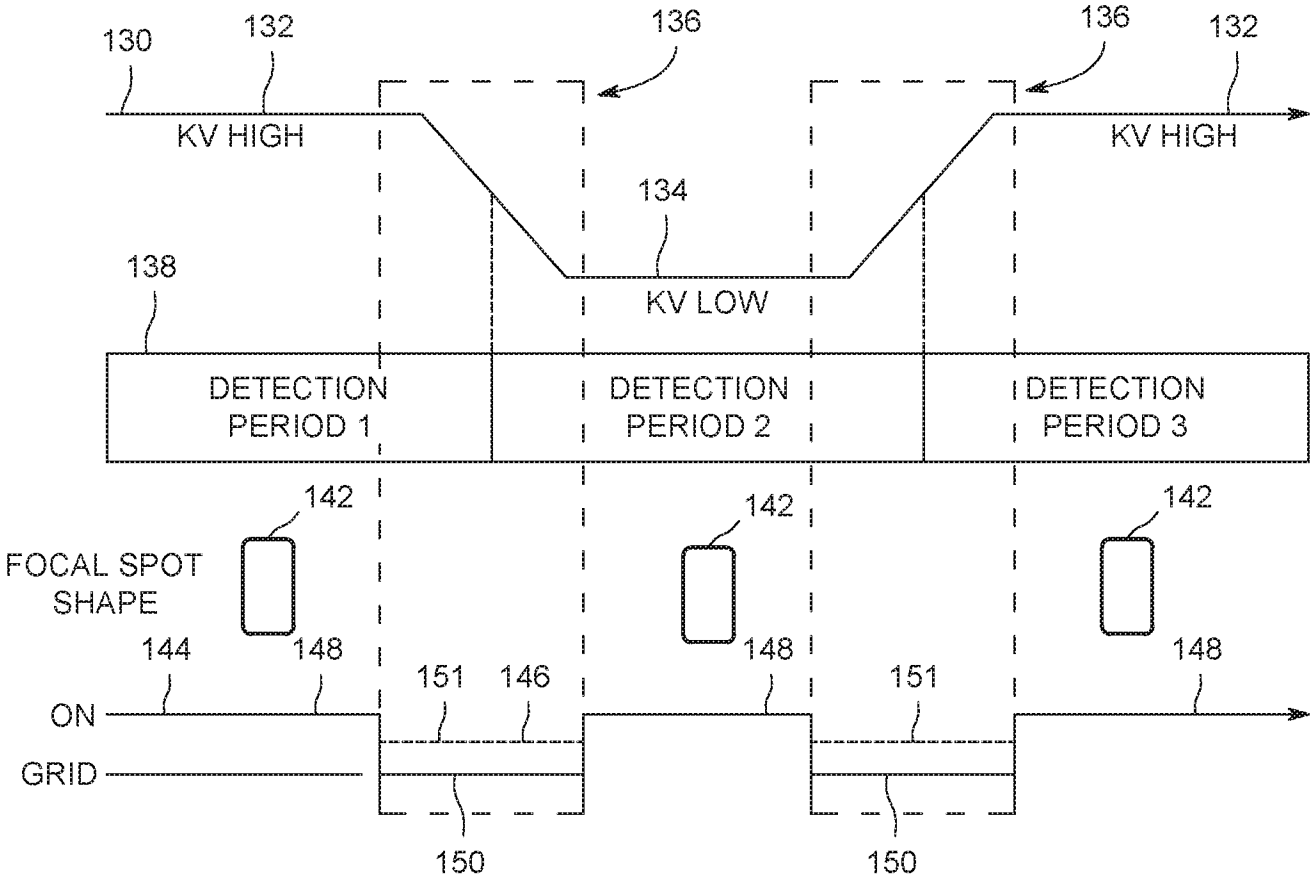
FIG. 9 is a schematic illustration of an embodiment of an effect of gridding an electron beam has on focal spot size during switching between different kVp levels.

Gridding of the electron beam 70 resolves the issues regarding mixed kV photons and focal spot shape artifacts in images. FIG. 9 is a schematic illustration of the effect of gridding the electron beam 70 during planned transitions 136 between the different kVp levels 132, 134 has on focal spot size instability. Plots 144 (solid line, 146 (dotted line) represents the effect of the gridding electrode 58 on the electron beam 70. Plot 144 depicts gridding the electron beam 70 in a binary manner (i.e., on (not gridded)/off (completely gridded)). As depicted in plot 144, when power is provided to the gridding electrode 58 at a specific non-gridding level, such as +6000 V (as indicated by reference numeral 148), the electron beam 70 is not gridded and can impact the anode 66. Also as depicted in plot 144, during the planned (e.g., pre-programmed or intentional) transitions 136 during the dynamic focal spot mode, when power is provided at a specific level (e.g., −3000 V to −5000 V) to the gridding electrode 58 (as indicated by reference numeral 150), the electron beam 70 is fully gridded. In certain embodiments, the electron beam 70 may be partially gridded (i.e., reducing the electron beam 70 that impacts the anode 66). Plot 146 depicts an example where the gridding electrode 58 is powered at a non-gridding level (e.g., +6000 V, as indicated by reference numeral 148) to enable the full electron beam 70 to impact the anode 66, and then switches to a partially gridding level (e.g., less than +6000 V to −3000 V, as indicated by reference numeral 151) to enable a portion of the electron beam to impact the anode 66. For example, as depicted in plot 146, the electron beam 70 is partially gridded during the transitions 136. In certain embodiments, the electron beam 70 may be partially gridded during the kVp levels 132, 134 and fully gridded during the transitions 136. Fully gridding the electron beam 70 during the transitions 136, as depicted in FIG. 9 avoids the focal spot shape artifacts (e.g., focal spot shape 140) and the mixed kV photons being acquired in the images.

Figure 10:
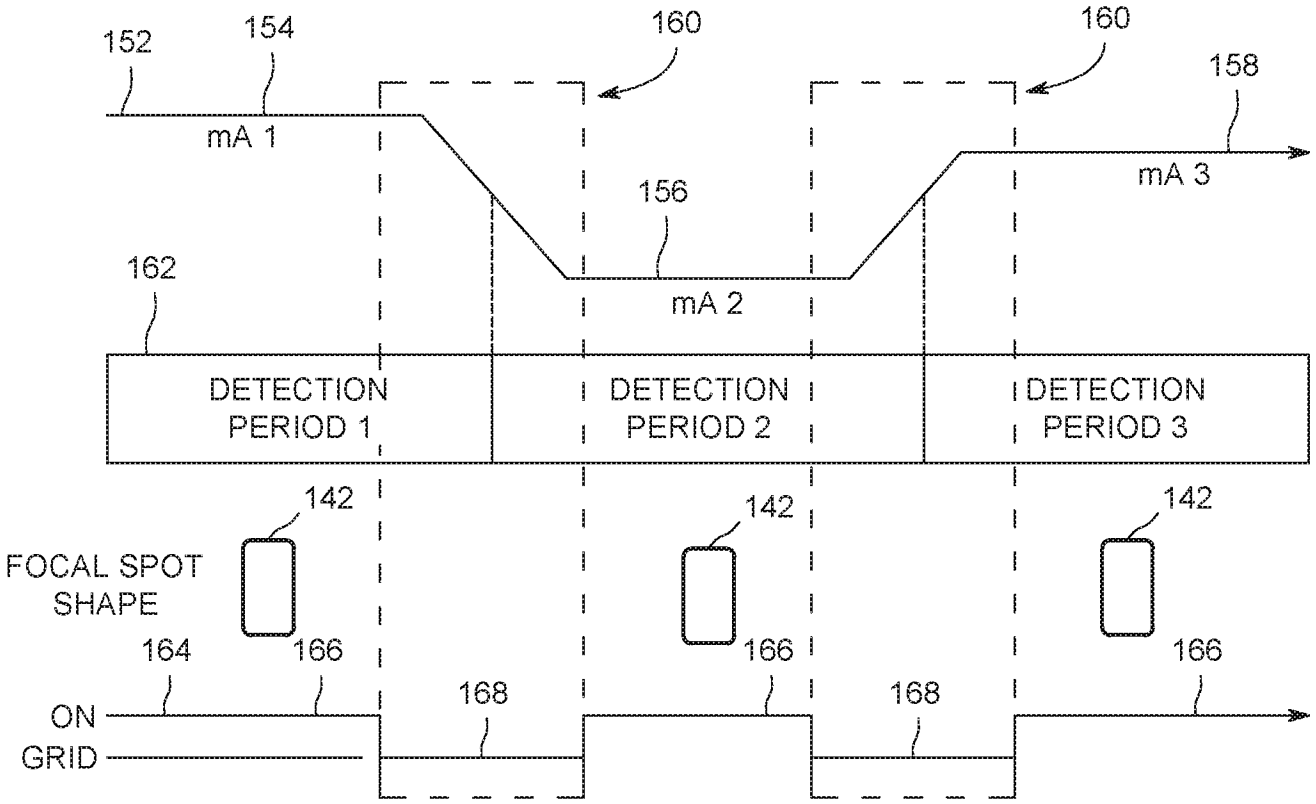
FIG. 10 is a schematic illustration of an embodiment of an effect of gridding an electron beam has on focal spot size instability during switching between different mA levels.

Focal spot shape artifacts as seen in FIG. 8 can also occur during changes or switches between different current levels (mA) applied across the X-ray tube 12. Gridding of the electron beam 70 resolves the issues regarding focal spot shape artifacts in images during these changes in current levels. FIG. 10 is a schematic illustration of the effect of gridding the electron beam 70 has on focal spot size instability during changes in current (mA) levels applied across the X-ray tube 12. Plot 152 depicts the mA level. As depicted, the mA level is switched between a first mA, mA 1, represented by reference numeral 154, a second mA, mA2, represented by reference numeral 156, and a third mA, mA 3, represented by reference numeral 158 (all of which may be different from each other). The dashed areas 160 represent the planned transitions between the different mA levels 154, 156, 158. FIG. 10 further depicts the detection periods 162 (e.g., by the detector electronics 108) generally corresponding with the different mA levels 154, 156, 158. These detection periods 162 also overlap with the transitions 160 between the mA levels.

Plot 164 represents the effect of the gridding electrode 58 on the electron beam 70. Plot 164 depicts gridding the electron beam 70 in a binary manner (i.e., on (no gridding)/off (complete gridding). As depicted in plot 164, when power is provided to the gridding electrode 58 at a specific non-gridding level, such as +6000 V (as indicated by reference numeral 166), the electron beam 70 is not gridded and can impact the anode 66. Also, as depicted in plot 164, during the planned (e.g., pre-programmed or intentional) transitions 160 during the dynamic focal spot mode, when power is provided to the gridding electrode 58 at a specific level (e.g., −3000 V to −5000 V, as indicated by reference numeral 168), the electron beam 70 is fully gridded. In certain embodiments, the electron beam 70 may be partially gridded (as described in FIG. 9). Fully gridding the electron beam 70 during the transitions 160, as depicted in FIG. 10 avoids the focal spot shape artifacts (e.g., focal spot shape 140 in FIG. 8) being acquired in the images. In addition, gridding of the electron beam 70 avoids damage to the X-ray tubes 12 due to focal spot size variation for the reasons discussed above.

Technical effects of the disclosed embodiments include providing a gridding electrode to grid the electron beam emitted by the cathode. The X-ray controller/power supply actively manages the gridding of the electron beam via the gridding electrode so that the electron beam is gridded during planned transitions between different focal spot positions (e.g., during focal spot wobbling), different focal spot sizes or shapes, different peak kVp applied across the X-ray tube, different mA applied across the X-ray tube, or a combination thereof during dynamic focal spot modes. Gridding the electron beam in synchronization with the transitions during a dynamic focal spot mode increases the life of the X-ray tube by avoiding X-ray tube damage due to focal spot instability. In addition, gridding the electron beam in synchronization with the transitions avoids the acquisition of focal spot artifacts in the image data due to focal spot instability. Further, gridding the electron beam in synchronization with the transitions avoids overheating or re-heating issues increasing the overall beam power and, thus, the X-ray flux that can be utilized.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray imaging system, comprising:

an X-ray tube, comprising:

an electron beam source comprising a single cathode configured to emit an electron beam;

an anode assembly comprising an anode configured to receive the electron beam and to emit X-rays when impacted by the electron beam; and a single gridding electrode disposed about a path of the electron beam between the electron beam source and the anode assembly;

a power supply electrically coupled to the electron beam source and the single gridding electrode, wherein the power supply is configured to power both the electron beam source and the single gridding electrode, and the single gridding electrode when powered by the power supply at a specific level is configured to grid the electron beam; and a controller coupled to the power supply and configured to regulate the power supply in providing power to both the electron beam source and the single gridding electrode, wherein the controller is programmed to synchronize the gridding of the electron beam by the single gridding electrode with planned transitions during a dynamic focal spot mode, wherein the dynamic focal spot mode comprises switching between different peak kilovoltages applied across the X-ray tube, the planned transitions comprise the switches between the different peak kilovoltages, and the gridding of the electron beam only occurs during the switches between the different peak kilovoltages.

2. The X-ray imaging system of claim 1, wherein the controller is programmed to cause the power supply to provide power to the single gridding electrode at the specific level to fully grid the electron beam during the planned transitions to block the electron beam from impacting the anode.

3. The X-ray imaging system of claim 1, wherein the controller is programmed to cause the power supply to provide power to the single gridding electrode at the specific level to partially grid the electron beam during the planned transitions to reduce the electron beam that impacts the anode.

4. The X-ray imaging system of claim 1, wherein the dynamic focal spot mode comprises switching between different milliamperes applied across the X-ray tube, and the planned transitions comprise the switches between the different milliamperes.

5. The X-ray imaging system of claim 1, wherein the dynamic focal spot mode comprises switching between different focal spot positions on the anode, and the planned transitions comprise the switches between the different focal spot positions on the anode.

6. The X-ray imaging system of claim 5, wherein the gridding of the electron beam is configured to avoid re-heating of a target surface of the anode between the different focal spot positions by the electron beam at least during switching between the different focal spot positions.

7. The X-ray imaging system of claim 5, wherein the gridding of the electron beam enables the application of an increased overall power of the electron beam and resulting X-ray flux relative to not gridding the electron beam during the planned transitions.

8. The X-ray imaging system of claim 1, wherein the dynamic focal spot mode comprises switching between different focal spot sizes or shapes on the anode, and the planned transitions comprise the switches between the different focal spot sizes or shapes on the anode.

9. The X-ray imaging system of claim 1, wherein the gridding of the electron beam is configured to avoid acquiring focal spot shape artifacts or degraded resolution in image data acquired by the X-ray imaging system.

10. The X-ray imaging system of claim 1, wherein the gridding of the electron beam is configured to avoid damage to the X-ray tube due to focal spot size instability.

11. The X-ray imaging system of claim 1, wherein the X-ray imaging system comprises a computed tomography imaging system.

12. An X-ray tube, comprising:

an electron beam source comprising a single cathode configured to emit an electron beam;

an anode assembly comprising an anode configured to receive the electron beam and to emit X-rays when impacted by the electron beam; and a single gridding electrode disposed about a path of the electron beam between the electron beam source and the anode assembly, wherein the single gridding electrode, when powered at a specific level, is configured to grid the electron beam in synchronization with planned transitions during a dynamic focal spot mode, wherein the dynamic focal spot mode comprises switching between different milliamperes applied across the X-ray tube, the planned transitions comprise the switches between the different milliamperes, and the gridding of the electron beam only occurs during the switches between the different milliamperes.

13. The X-ray tube of claim 12, wherein the single gridding electrode, when powered to the specific level, is configured to fully grid the electron beam during the planned transitions to block the electron beam from impacting the anode.

14. The X-ray tube of claim 12, wherein the single gridding electrode, when powered to the specific level, is configured to partially grid the electron beam during the planned transitions to reduce the electron beam that impacts the anode.

15. The X-ray tube of claim 12, wherein the dynamic focal spot mode comprises switching between different peak kilovoltages applied across the X-ray tube, and the planned transitions comprise the switches between the different peak kilovoltages.

16. The X-ray tube of claim 12, wherein the dynamic focal spot mode comprises switching between different focal spot positions on the anode, and the planned transitions comprise the switches between the different focal spot positions on the anode.

17. The X-ray tube of claim 16, wherein the gridding of the electron beam is configured to avoid re-heating of a target surface of the anode between the different focal spot positions by the electron beam during at least switching between the different focal spot positions.

18. The X-ray tube of claim 12, wherein the dynamic focal spot mode comprises switching between different focal spot sizes or shapes on the anode, and the planned transitions comprise the switches between the different focal spot sizes or shapes on the anode.

19. The X-ray tube of claim 12, wherein the gridding of the electron beam is configured to avoid acquiring focal spot shape artifacts in image data acquired by the X-ray imaging system.

20. A method for making an X-ray tube, comprising:

assembling the X-ray tube comprising an electron beam source comprising a single cathode configured to emit an electron beam and an anode assembly comprising an anode configured to receive the electron beam and to emit X-rays when impacted by the electron beam; and disposing a single gridding electrode about a path of the electron beam between the electron beam source and the anode assembly, wherein the single gridding electrode, when powered at a specific level, is configured to grid the electron beam in synchronization with planned transitions during a dynamic focal spot mode, wherein the dynamic focal spot mode comprises switching between different peak kilovoltages applied across the X-ray tube, the planned transitions comprise the switches between the different peak kilovoltages, and the gridding of the electron beam only occurs during the switches between the different peak kilovoltages.

* * * * *